United States Patent [19]

Thomas

[11] 4,108,780

[45] Aug. 22, 1978

[54] DUSTLESS SOIL RELEASE-SOURING COMPOSITIONS FOR USE IN LAUNDERING

[75] Inventor: Paul Vernon Thomas, Berwyn, Pa.

[73] Assignee: Pennwalt Corporation, Philadelphia, Pa.

[21] Appl. No.: 816,994

[22] Filed: Jul. 19, 1977

[51] Int. Cl.[2] ..... D06M 15/08

[52] U.S. Cl. ..... 252/8.6; 8/115.6; 252/8.8; 252/88

[58] Field of Search ..... 252/8.6, 8.8; 8/115.6 A, 137

[56] References Cited

U.S. PATENT DOCUMENTS

| | | | |
|---|---|---|---|
| 2,344,671 | 3/1944 | Bertsch | 252/123 |
| 3,163,607 | 12/1964 | Drake | 252/170 |
| 3,650,801 | 3/1972 | Hinton et al. | 8/115.6 A |
| 3,782,898 | 1/1974 | Mandell | 8/137 |
| 3,836,496 | 9/1974 | Dickson | 8/115.6 A |

FOREIGN PATENT DOCUMENTS

| | | | |
|---|---|---|---|
| 631,086 | 11/1961 | Canada | 252/88 |
| 772,801 | 4/1957 | United Kingdom | 252/88 |
| 842,791 | 7/1960 | United Kingdom | 252/88 |

*Primary Examiner*—William E. Schulz

[57] ABSTRACT

Acrylic homopolymers and copolymers are being used in laundering operations to impregnate fabrics to render them soil and stain resistant. In finely divided form these acrylic resins are extremely dusty. Dedusting agents for acrylic resins and dustless compositions are disclosed which are suitable for fabric impregnation during laundering.

14 Claims, No Drawings

DUSTLESS SOIL RELEASE-SOURING COMPOSITIONS FOR USE IN LAUNDERING

BRIEF DESCRIPTION OF THE INVENTION

Synthetic fabrics have created problems in laundering especially when stained with oil and grease. A recent patent, U.S. Pat. No. 3,782,898 entitled "Temporary Soil Release Resins Applied to Fabrics in Laundering" teaches the use of acrylic resins for the impregnation of fabrics in the final step of a laundering operation to provide good soil release and stain removal. This process is repeated with each subsequent washing thereby keeping the fabrics in serviceable condition. This patent describes a process which requires a sour to be added, either with the resin or before the resin in the final step of the laundering process. The sour is necessary in order to lower the pH within the range of about 4 to about 6.5 to remove strong alkali from the fabrics and in addition it is the best pH range for making the most efficient use of the resins in removing soil and stains.

With the introduction of the soil release type acrylic resins for use in laundering operations, the chemical industry has begun marketing concentrates of powdered acrylic resins either by themselves or in combination with powdered or granular souring agents and optionally, other fabric finishing agents, namely fabric sizing, brighteners, softeners, mildewstats, flame retarding agents and similar materials. Since the acrylic resins are normally produced and marketed as aqueous emulsions, the need for anhydrous acrylic resins required that they be spray dried.

Spray-dried acrylic resins are extremely dusty and the eye and lung irritation experienced by chemical operators or laundry operators handling these products has been so great that they have refused to handle them. I have discovered two organic alcohols which are effective dedusting agents for spray-dried acrylic resins which are also compatible with the fabrics.

In addition to being effective dedusting agents for spray-dried acrylic resins, when the acrylic resins are used as soil release agents for fabrics the dedusting agents must not discolor or render unattractive the fabrics which are treated with the resins. Many conventional dedusting agents were found unsuitable for my compositions because they left an unpleasant odor on fabrics treated with my compositions. Many other conventional dedusting agents were unsuitable because they were not effective dedusters over a long period of time or they left soil and particulate matter on the fabrics or they caused agglomerates such as white moats on shirts.

I have discovered two organic alcohols which are effective dedusting agents for spray-dried acrylic resins. I have also discovered that these same two organic alcohols are effective dedusting agents for acrylic resins in combination with solid granular laundry sours and also in the combination of acrylic resin, laundry sour and one or more fabric finishing agents. The two organic alcohols which are effective dedusting agents in my compositions are 2-hexyldecyl alcohol and iso-tridecanol.

The acrylic resins, laundry sours, fabric sizing agents and fabric finishing agents are applied to fabrics in the manner and at the same concentrations as are disclosed in U.S. Pat. No. 3,782,898 and Ser. No. 623,700 which are incorporated herein by reference.

DETAILED DESCRIPTION OF INVENTION

Spray-dried acrylic resins are extremely dusty materials. When a container of spray-dried acrylic resin is opened one can see a cloud of resin dust appearing above the container even if the container has not been disturbed. When a formulator attempts to blend a spray-dried acrylic resin with other materials the acrylic resin will pervade the entire area of the room in which the blending takes place.

Dedusting of the spray-dried acrylic resins which are to be used for temporary impregnation of fabrics to obtain soil release properties present problems in addition to the control of dust. The dedusting agents cannot impart an objectional odor to the fabrics. Moreover, the dedusting agents cannot appear as discreet particles on the fabrics which would mar the fabric appearance. Neither can the dedusting agents cause agglomerates or moats on the fabrics or leave oil spots.

I have discovered two organic alcohols which meet the stringent requirements for suitability as dedusting agents for acrylic resins per se or for acrylic resins suitable for applying to fabrics. These alcohols are 2-hexyldecyl alcohol and iso-tridecanol. These organic alcohols are available as articles of commerce. The 2-hexyldecyl alcohol can be purchased under the trademark STANDAMUL GT-16 from Henkel, Inc. while the iso-tridecanol can be purchased from Exxon Chemicals Company.

The organic dedusting agents are effective in dedusting any spray-dried acrylic resin. The dedusting agents are effective in dedusting acrylic resins derived by the homopolymers and copolymers of acrylic acid and methacrylic acid.

The acrylic resins which are suitable for application to fabrics for temporary soil release purposes which are dedusted with my two organic alcohols are homopolymers and copolymers of acrylic acid and methacrylic acid.

The spray-dried homopolymers which form suitable soil release resins are polyacrylic acid and polymethacrylic acid. Either homopolymer or mixtures of the homopolymers provide satisfactory soil release resins for textile fabrics in my process.

In addition to the homopolymers described above, various spray-dried copolymers formed by copolymerizing acrylic or methacrylic acid with alkyl esters of acrylic acid or methacrylic acid are satisfactory, soil release resins. In these copolymers the mole ratio of acrylic acid or methacrylic acid to the alkyl esters of acrylic acid or methacrylic acid must be at least 1 to 1 in order to provide water solubility or water dispersibility of the copolymer. Any ratio of acid to ester greater than 1 to 1 including the acid homopolymers provide suitable soil release resins. The alkyl substituents are $C_1$ through $C_4$ groups. Mixtures of these copolymers are also satisfactory temporary soil release resins.

Esters suitable for copolymerizing with acrylic acid or methacrylic acid to provide satisfactory temporary soil release resins are methyl acrylate, ethyl acrylate, n-propyl acrylate, isopropyl acrylate, n-butyl acrylate, isobutyl acrylate, methyl methacrylate, ethyl methacrylate, n-propyl methacrylate, isopropyl methacrylate, n-butyl methacrylate and isobutyl methacrylate.

In addition to the copolymers described above which are useful temporary soil release resins, mixtures of the homopolymers with the various copolymers described above are particularly useful as temporary soil release resins.

Any ratio of mixtures of the homopolymers or mixtures of homopolymers and copolymers described above provides suitable temporary soil release resins for practicing my invention.

A preferred temporary soil release system comprises mixtures of the homopolymer of acrylic acid and copolymer formed from ethyl acrylate and methacrylic acid.

The spray-dried homopolymers and copolymers and their mixtures described above are hereinafter referred to in the specification and claims as acrylic resins.

The 2-hexyldecyl alcohol and/or the iso-tridecanol or mixtures thereof are added to the spray-dried acrylic resin in an amount sufficient to prevent the formation of a cloud of resin particles above a freshly opened container which is termed a substantially dustless composition or mixture. This amount will be known as a dedusting amount of organic alcohol as hereinafter used in the specification and claims. I have found that as little as about 0.05% by weight of the organic alcohol will effectively dedust the acrylic resins. Amounts as high as about 2.0% by weight have also been effective. Higher concentrations can be used without additional dedusting benefit.

When spray-dried polyvinyl alcohol is used in the compositions the minimum amount of organic alcohol is 0.5% weight. A preferred concentration of organic alcohol for dedusting is about 0.5% by weight. These concentration ranges apply to either dedusting the acrylic resin per se or to dedusting the acrylic resin in combination with one or more laundry sours, inert fillers and fabric finishing agents. The term "dedusting amount of organic alcohol" applies to the mixtures of acrylic resin with one or more of the laundry sours, inert fillers and fabric finishing agents in addition to the acrylic resin per se.

In another form of my invention the organic alcohols are used to dedust mixtures consisting essentially of acrylic resins suitable for impregnation of fabrics for temporary soil release purposes in combination with one or more laundry sours. The laundry sours useful in my composition are one or more of the acids or acid salts selected from the group consisting of acetic, hydroxyacetic, formic and oxalic acids; zinc, sodium, ammonium and magnesium fluosilicates; ammonium chloride; and sodium and ammonium acid fluorides. The laundry sours are used in the laundry operation in an amount to provide a pH within the range of about 4 to 6.5 and the amount of sour required will depend on the extent of residual alkalinity carried over in the fabrics from the alkaline detergent washing cycle.

In the compositions of my invention consisting essentially of acrylic resin, laundry sour and organic alcohol the useful concentration ranges are acrylic resin — 33.35 to 46%, laundry sour — 66.6 to 53% and one or more organic alcohols selected from the group consisting of 2-hexyldecyl and iso-tridecanol — 0.05 to 2%, all percentages being by weight.

In another form of my invention the substantially dustless mixture will consist essentially of acrylic resin, laundry sour, inert filler and organic dedusting alcohol. The inert fillers are used to vary the concentration of the active ingredients as may be necessary or desirable to meet varying commercial laundering operations. For example, greasy coveralls are washed in very strong detergent solutions which means more detergent carry over into the souring operation.

The inert fillers which I prefer to use in my compositions are sodium chloride and/or sodium sulfate since these materials form essentially neutral aqueous solutions. Other fillers such as soda carbonate, sodium bicarbonate, and potassium carbonate can be used but these alkalis will increase the consumption of acid in the souring operation. Acid salts such as sodium acid sulfate can also be used but are not preferred. Mixtures of inert fillers can also be used.

In the compositions which include the inert filler useful concentration ranges are acrylic resin — 10 to 20%, laundry sour — 20% to 35%, inert filler — 39.95 to 33% and one or more organic alcohols selected from the group group consisting of 2-hexyldecyl alcohol and iso-tridecanol — 0.05 to 2.0%, all percentages being by weight.

In another form of my invention the substantially dustless mixture will consist essentially of acrylic resin, laundry sour, inert filler, organic dedusting alcohol and one or more fabric finishing agents. The term fabric finishing agent includes fabric brighteners, fabric softeners, mildewstats, bacteriastats, flame retarding agents, blueing and sizing. A preferred fabric finishing agent is sizing material.

The sizing materials will be one or more members selected from the group consisting of natural starches such as corn, rice and potato; and synthetic sizing agents such as polyvinyl alcohol, cellulose derivatives and polyvinyl acetate. These materials are well known in the commercial laundry field and are ready available from many manufacturers.

In the substantially dustless mixtures which include the fabric finishing agent the useful concentration ranges are acrylic resin — 10% to 20%, laundry sour — 20 to 35%, fabrich finishing agent — 69.95 to 10%, one or more organic alcohols selected from the group consisting of 2-hexyldecyl alcohol and iso-tridecanol — 0.05 to 2.0%, and optionally an inert filler — 0 to 33%, all percentages being by weight.

In the substantially dustless compositions which consist of a fabric sizing as the sole fabric finishing agent in combination with acrylic resin and laundry sour the useful concentration ranges are acrylic resin — 10 to 26%, laundry sour — 29 to 46%, sizing — 60.5 to 26% and one or more organic alcohols selected from the group consisting of 2-hexyldecyl and iso-tridecanol — 0.5 to 2.0%, all percentages being by weight.

The substantially dustless compositions of my invention are easily prepared by adding one or more of the organic alcohols to the mixtures to be dedusted in conventional blending apparatus. It is preferable to add the organic alcohol as the last ingredient since it is the smallest amount in the mixtures. Any conventional blending or mixing apparatus can be used and satisfactory blending to produce a substantially dustless mixture will take place in about 2 to 15 minutes.

A consideration of the following examples will demonstrate the best mode of practicing my invention.

EXAMPLE 1

125 grams of sodium silicofluoride was added to a Hockmeyer blender. 75 grams of dusty spray-dried acrylic resin was then added. 299.5 grams of sodium chloride was next added. 0.5 grams of 2-hexyldecyl alcohol was added and the blender was turned on.

Blending continued for 5 minutes. The product was powdery in appearance, like flour and was free of dust.

EXAMPLE 2

3.7 pounds of dusty spray-dried white free flowing acrylic resin was charged to a Hockmeyer blender. 6.25 pounds of dusty polyvinyl acetate (spray-dried water dispersible type-bulk density 33 pounds per cubic foot) was next added to the blender. Finally, 18 grams (0.05 pounds) of 2-hexyldecyl alcohol was added to the blender and blending continued for about 5 minutes. The product was fluffy, flour-like and was dustless. The product was nearly odorless.

EXAMPLE 3

125 pounds of dusty polyvinyl acetate was charged to a ribbon blender. 125 pounds of granular sodium siliofluride and 171 pounds of a fine, white powdered wheat based laundry starch were then added to the blender. 75 pounds of spray-dried acrylic resin was added to the blender and a cloud of dust appeared even tho the blender was motionless. 3 pounds of 2-hexyldecyl alcohol was added and the ribbon blender was started. After about 10 minutes the blended product was substantially dustless. Storage stability tests showed that the product was still substantially dustless after about 1 year's storage.

EXAMPLE 4

14.9 grams of spray-dried acrylic resin was placed in a jar. 0.015 grams of 2-hexyldecyl alcohol was added. The mixture was stirred for about 5 minutes. After stirring the resin mixture was dustless.

EXAMPLE 5

99.95 grams of spray-dried acrylic resin was placed in a container and 0.05 grams of iso-tridecanol was added. The mixture was stirred about 5 minutes. When inverted in a closed container, the cloud of dust was substantially reduced.

EXAMPLE 6

98.2 grams of spray-dried acrylic resin was placed in a container and 1.8 grams of iso-tridecanol was added and stirred for about 5 minutes. After stirring, the mixture was substantially dustless. No odor different from the acrylic resin was detected.

EXAMPLE 7

35 grams of spray-dried acrylic resin was placed in a container and 64 grams of sodium silicofluoride was added. Then 1 gram of 2-hexyldecyl alcohol was added and the mixture was stirred for about 2 minutes. The mixture was dustless and had very little ordor.

EXAMPLE 8

69.95 grams of sodium sulfate, 20 grams of sodium silicofluoride and 10 grams of spray-dried acrylic resin were placed in a container. 0.05 grams of iso-tridecanol was added and the mixture was stirred about 2 minutes. After stirring the mixture was dustless.

EXAMPLE 9

35 grams of sodium silicofluoride, 43 grams of anhydrous sodium sulfate and 20 grams of spray-dried acrylic resin were placed in a container. 2 grams of iso-tridecanol was added and the mixture stirred about 2 minutes. The mixture was quite dustless.

EXAMPLE 10

35 grams of ammonium silicofluoride, and 43.7 grams of wheat based starch were added to a container. This was followed by 10 grams of spray-dried polyvinyl acetate sizing (2–6 microns particle size) and 10 grams of spray-dried acrylic resin. 0.1 grams of Hilton-Davis fluorescent fabric brightener was then added followed by 1.2 grams of iso-tridecanol. After stirring about 2 minutes the mixture was quite dustless and with no objectionable odor.

EXAMPLE 11

52.4 grams of wheat based starch and 20 grams of zinc silicofluoride were placed in a container. This was followed by 26 grams of dusty spray-dried acrylic resin and 0.2 grams of Irgasan DP-300 mildewstat. Finally, 1.4 grams of 2-hexyldecyl alcohol was added and the mixture was stirred about 2 minutes. The stirred product was dustless and with no objectionable odor.

The above products were used to treat polyester — cotton fabrics, cotton and linens in commercial laundry operations in the manner disclosed in U.S. Pat. No. 3,782,898 and Ser. No. 623,700 which are incorporated by reference. The impregnation of the acrylic resin in the fabrics was complete and no visible moats or discrete particles were observed on the fabrics. No highlighting was observed on polyester or linen fabrics even when examined with a microscope. No odor was detectable on any of the laundered fabrics which had been treated with the compositions of my invention.

I claim:

1. A substantially dustless powdered composition consisting essentially of spray-dried acrylic resin and a dedusting amount of one or more organic alcohols selected from the group consisting of 2-hexyldecyl alcohol and iso-tridecanol.

2. The composition of claim 1 in which the organic alcohol is present at a concentration within the range of about 0.05 to 2.0%.

3. A substantially dustless powdered or granular composition for use in laundering consisting essentially of spray-dried acrylic resin, laundry sour and a dedusting amount of an organic alcohol selected from the group consisting of 2-hexyldecyl alcohol and iso-tridecanol.

4. The composition of claim 3 in which the organic alcohol is present at a concentration of about 0.05 to 2.0% weight.

5. A substantially dustless powdered or granular composition for use in laundering consisting essentially of the following materials expressed in percent by weight:

spray-dried acrylic resin: 33.35 to 46,
laundry sour: 66.6 to 53,
and one or more organic alcohols selected from the group consisting of 2-hexyldecyl alcohol and iso-tridecanol: 0.05 to 2.

6. A substantially dustless powdered or granular composition for use in laundering consisting essentially of spray-dried acrylic resin, laundry sour, inert filler and a dedusting amount of at least one organic alcohol selected from the group consisting of 2-hexyldecyl alcohol and iso-tridecanol.

7. The composition of claim 6 in which the organic alcohol is present at a concentration within the range of about 0.05 to 2.0% weight.

8. A substantially dustless powdered or granular composition for use in laundering consisting essentially of the following materials expressed as percent by weight:

spray-dried acrylic resin: 10 – 20,
laundry sour: 20 – 35,
inert filler: 69.95 – 43,
and at least one organic alcohol selected from the group consisting of 2-hexyldecyl alcohol and iso-tridecanol: 0.05 – 2.0.

9. A substantially dustless powdered or granular composition for use in laundering consisting essentially of spray-dried acrylic resin, laundry sour, inert filler, fabric finishing agent and a dedusting amount of at least one organic alcohol selected from the group consisting of 2-hexyldecyl alcohol and iso-tridecanol.

10. The composition of claim 9 in which the organic alcohol is present at a concentration within the range of about 0.05 to 2.0% weight.

11. A substantially dustless powdered or granular composition for use in laundering consisting essentially of the following materials expressed as percent by weight:

spray-dried acrylic resin: 10 – 20,
laundry sour: 20 – 35,
inert filler: 39.95 – 33,
fabric finishing agent: 30 – 10,
and at least one organic alcohol selected from the group consisting of 2-hexyldecyl alcohol and iso-tridecanol: 0.05 to 2.0.

12. A substantially dustless powdered or granular composition for use in laundering consisting essentially of spray-dried acrylic resin, laundry sour, fabric sizing material, and a dedusting amount of at least one organic alcohol selected from the group consisting of 2-hexyldecyl alcohol and iso-tridecanol.

13. The composition of claim 12 in which the organic alcohol is present at a concentration within the range of about 0.05 to 2.0% weight.

14. A substantially dustless powdered or granular composition for use in laundering consisting essentially of the following materials expressed as percent by weight:

spray-dried acrylic resin: 14 – 26,
laundry sour: 29 – 46,
fabric sizing: 56.95 – 26,
and at least one organic alcohol selected from the group consisting of 2-hexyldecyl alcohol and iso-tridecanol: 0.05 – 2.

* * * * *